US010584585B2

(12) United States Patent
Helming

(10) Patent No.: US 10,584,585 B2
(45) Date of Patent: Mar. 10, 2020

(54) TUNNELING FOR UNDERGROUND POWER AND PIPELINES

(71) Applicant: Arcbyt, Inc., Berkeley, CA (US)

(72) Inventor: Troy Anthony Helming, Oakland, CA (US)

(73) Assignee: ARCBYT, INC., Berkeley, CA (US)

( * ) Notice: Subject to any disclaimer, the term of this patent is extended or adjusted under 35 U.S.C. 154(b) by 156 days.

(21) Appl. No.: 15/814,311

(22) Filed: Nov. 15, 2017

(65) Prior Publication Data

US 2019/0085688 A1 Mar. 21, 2019

Related U.S. Application Data

(60) Provisional application No. 62/422,539, filed on Nov. 15, 2016.

(51) Int. Cl.

| | |
|---|---|
| ***E21B 7/14*** | (2006.01) |
| ***E21D 9/10*** | (2006.01) |
| ***E21B 7/15*** | (2006.01) |
| ***E21B 4/16*** | (2006.01) |

(52) U.S. Cl.

CPC ..... *E21D 9/1073* (2013.01); *E21B 4/16* (2013.01); *E21B 7/14* (2013.01); *E21B 7/15* (2013.01); *E21D 9/108* (2013.01)

(58) Field of Classification Search

CPC ..... E21B 7/14; E21B 9/1073; E21B 9/108; E21D 9/1073; E21D 9/108

See application file for complete search history.

(56) References Cited

U.S. PATENT DOCUMENTS

| | | | | |
|---|---|---|---|---|
| 3,467,206 | A * | 9/1969 | Acheson | E21B 7/14 175/13 |
| 3,840,270 | A | 10/1974 | Allgood | |
| 5,771,984 | A * | 6/1998 | Potter | E21B 7/14 175/14 |
| 2011/0120771 | A1 | 5/2011 | Montaron | |
| 2014/0008124 | A1 | 1/2014 | Ma | |
| 2014/0008968 | A1 | 1/2014 | Moeny | |
| 2014/0231398 | A1 | 8/2014 | Land et al. | |
| 2016/0024849 | A1 | 1/2016 | Kocis et al. | |
| 2017/0204669 | A1 | 7/2017 | Lehr et al. | |

FOREIGN PATENT DOCUMENTS

| | | | |
|---|---|---|---|
| GB | 1446464 | A | 8/1976 |

OTHER PUBLICATIONS

International Search Report and Written Opinion for International Application No. PCT/US2018/060961; dated Feb. 11, 2019; 8 pages.

* cited by examiner

*Primary Examiner* — Brad Harcourt

(74) *Attorney, Agent, or Firm* — Perkins Coie LLP

(57) ABSTRACT

The present application describes a rapid burrowing robot (RBR) that can dig tunnels using ultra high temperature rotating plasma torches.

21 Claims, 13 Drawing Sheets

Mother Rig

Father Rig

TUNNELING FOR UNDERGROUND POWER AND PIPELINES

RELATED APPLICATION

The present application claims priority to U.S. Provisional Application No. 62/422,539, filed on Nov. 15, 2017, and incorporates that application in its entirety.

FIELD

The present invention relates to tunneling, and more particularly to using plasma for tunneling underground.

BACKGROUND

America is losing in the battle to lead the Clean Power Revolution, which is the largest shift of wealth the world has ever seen. Earth's largest industry, the energy industry, is shifting inexorably from coal/oil to solar/wind—just like previous centuries that ushered in similar transitions: from wood, whale oil and horses to coal, kerosene, and oil. The transition is inevitable, but America is losing—badly. Electricity costs are rising steadily, and oil and natural gas are unpredictable and generally increasing over time. Climate change damage to the economy is rising even faster, and common sense tells us that fossil fuels exacerbate climate change Renewable energy is now equal to or less than the cost of fossil fuel generated electricity. Electricity to fuel vehicles is cheaper than gas even if gas were less than $1.00 per gallon. Wind and solar are booming, adding tens of billions of dollars per year of newly installed projects at a 30%+ average compound annual growth rate. Studies show significant benefits to the US economy of clean power, including new jobs (wind turbine technician was the fastest growing job in the USA in 2015), efficiency gains, reduced health costs due to cleaner water and air and reduction of the rapidly increasing costs to the economy of climate change.

Wind & solar power plants now provide electricity that's cheaper than new or existing fossil fuels power plants. However, much of this potential clean, affordable resource remains unavailable to most people due to the lack of suitable transmission lines. Building the infrastructure to transmit and store this power is slow.

Existing tunnel boring machines are slow and expensive. Bertha is one of the world's largest tunnel boring machines. The speed of Bertha is about 10 m per day. It is also huge, at 17.5 m wide and nearly 100 m long, requiring assembly at each job site and then disassembly to move it to the next location, as well as needing large slurry pipes and a 2.7 km long conveyor belt to move soil out of the way by injecting water and chemicals in the broken soil until it runs into a soft paste slurry. Furthermore, such tunnel boring machines are expensive to operate. Bertha uses 18.6 MW of power and 25 people to keep it operating. The design for Bertha originated in 1825 by inventor Marc Isambard Brunel. Bertha stalled in December 2013 and required substantial repairs, delaying a tunnel project in Seattle Wash. by about 3 years.

BRIEF DESCRIPTION OF THE FIGURES

The present invention is illustrated by way of example, and not by way of limitation, in the figures of the accompanying drawings and in which like reference numerals refer to similar elements and in which.

DETAILED DESCRIPTION

The present application describes a rapid burrowing robot (RBR) that can dig tunnels using ultra high temperature rotating plasma torches. In one embodiment, the RBR can be used for placement of new high voltage transmission cables 10 to 55 times faster at 20% of the cost of conventional tunneling. New transmission lines networked into a new Energy Superhighway—or a Super-grid—can be installed quickly by the RBR deep underground where it won't bother people, and can move cheap, clean wind energy from the Great Plains and solar power from the desert Southwest. Being able to easily bring renewable energy to our biggest cities where it's needed will increase renewable energy use, and decrease its cost. The RBR gasifies and/or melts rocks underground to create a sealed tunnel. In one embodiment, the sealed tunnel can act as an airtight tube to store compressed air, as a battery. Moving away from coal, gas and oil to cheaper, more predictable wind, solar and other clean power sources means lower energy bills for consumers and businesses, cleaner air, cleaner water, and a reduction of $CO_2$ induced climate change.

The RBR uses innovative plasma and robotic technologies to tunnel quickly underground through rock and soil. The RBR primarily does this without mechanical drilling, or with reduced mechanical drilling. Using the RBR, it is possible to build subterranean tunnels which can then be lined with super high voltage transmission lines. In one embodiment, those tunnels could form a self-healing neural network of smart grid transmission lines that would be nearly impervious to vandalism, terrorist attacks or natural disasters, hardening and backing up our existing electrical and power system. In one embodiment, the tunnels could also double as batteries to store vast quantities of clean renewable energy, smoothing out availability. All this could be done without the need to spend decades to get the permits needed for dozens of new overhead transmission lines, at tunneling speeds many times faster than conventional boring drill rigs and at a fraction of the cost. Furthermore, by moving such lines underground, the potential damage and risk from adverse weather events and third-party attack is reduced.

The following detailed description of embodiments of the invention makes reference to the accompanying drawings in which like references indicate similar elements, showing by way of illustration specific embodiments of practicing the invention. Description of these embodiments is in sufficient detail to enable those skilled in the art to practice the invention. One skilled in the art understands that other embodiments may be utilized and that logical, mechanical, electrical, functional and other changes may be made without departing from the scope of the present invention. The following detailed description is, therefore, not to be taken in a limiting sense, and the scope of the present invention is defined only by the appended claims.

Figure 1:
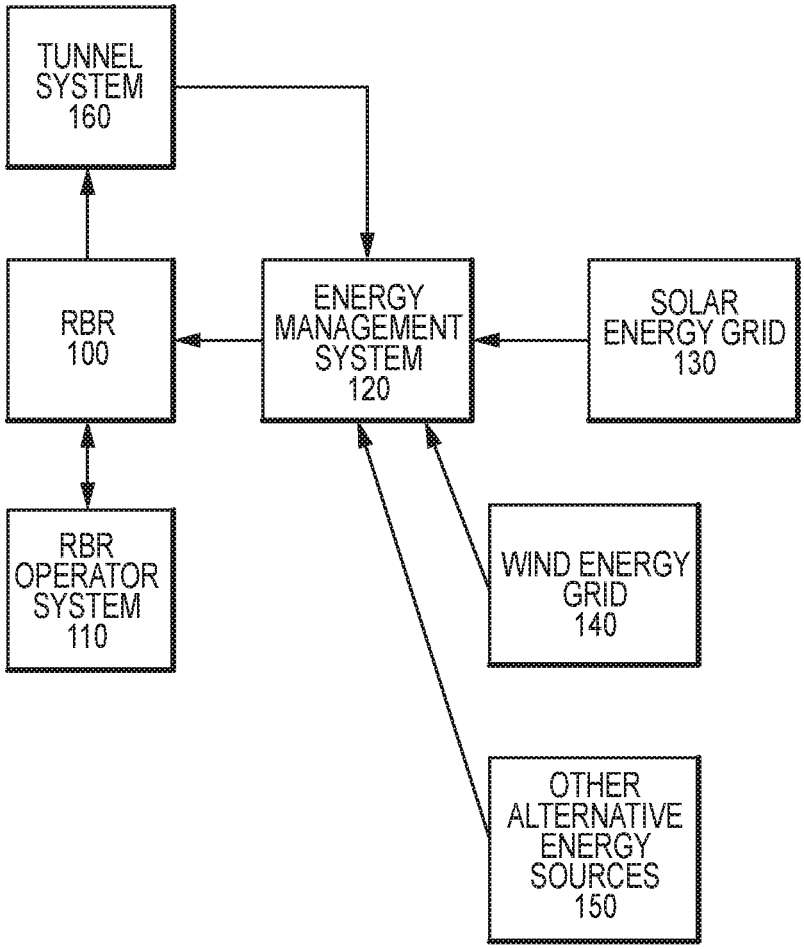
FIG. 1 is a system diagram showing the various elements of the system.

FIG. 1 illustrates a simplified high-level diagram of the system. The tunnel system 160 is drilled by the RBR 100, for energy management, in one embodiment. The RBR 100 is controlled by RBR operator system 110. In one embodiment, the operator system 110 provides instructions to the RBR 100 underground. In one embodiment, the operator system 110 may be a wired or wireless controller, which directs the RBR, and addresses any issues. In one embodiment, the RBR 100 may be partially or fully autonomous when no issues are encountered.

In one embodiment, the RBR 100 is powered using energy management system 120, which receives energy from various alternative energy sources. In one embodiment, this means that the energy management system 120 receives power from one or more of the solar energy grid 130, wind energy grid 140, and other alternative energy sources 150. The alternative energy sources 150 may be other renewable energy sources such as geothermal energy, hydroelectricity, tidal power, wave power, biofuel, etc. The specific forms of energy used depends on the availability and cost. In one embodiment, energy management system 120 may also use power from the electrical grid or other sources that may not use renewable sources. In one embodiment, the system preferentially uses energy during low use times, such as at night for wind power, or mid-morning for solar power.

In one embodiment, the system of tunnels 160 built by the RBR 100 can be used as part of energy management system 120. For example, in one embodiment sealed tunnel segments may be used as batteries for storing some power.

FIGS. 2A-2E illustrate one embodiment of the rapid burrowing robot (RBR). The RBR is a robotic boring machine that can bore (tunnel) quickly through rock, dirt and other subterranean material with few moving parts using electricity as its energy source. In one embodiment, it is equipped with a center pulse laser and multiple plasma torches operating at an adjustable angle relative to the center laser. The RBR uses intense heat to "drill" through rock and soil.

The energy for the RBR is DC (direct current), in one embodiment. The RBR is powered, in one embodiment, through a connection with the DC output of a wind farm, solar farm, or other renewable energy source. In one embodiment, the system may include energy storage. In one embodiment, the system may further have a backup connection to the grid with a high-powered AC to DC inverter to ensure a consistent power supply in the event that solar or wind energy is unavailable or insufficient.

In one embodiment, a centrally located pulse laser creates an initial guidance bore. In one embodiment, the guidance bore is at the center of the intended tunnel. For some tunneling applications where the rock melting point is below the maximum, the laser can be replaced with a center mounted plasma torch.

A series of plasma torches operating at very high temperatures of up to 28,000° C. are arranged in a circular design. In one embodiment, a rotating torch element 210 includes the torches, their support structure, and a shaft. In one embodiment, the torches are non-transferable plasma torches which do not touch the material to be gasified, but rather complete the circuit between the cathode and anode of the torch, and use compressed air to provide a larger plume size. In one embodiment, the torches are transferable plasma torches which use a clamp attached to the material to be gasified. In one embodiment, the plasma torches are cooled using water or another coolant, circulating through the system.

Figure 2A:
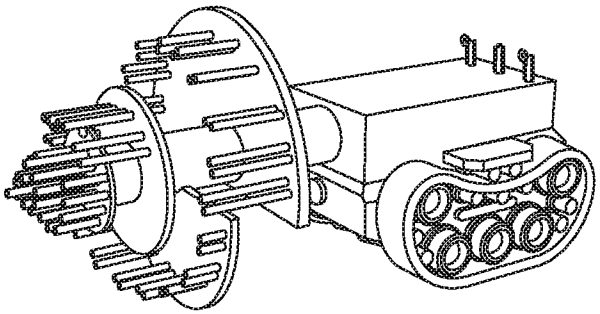
FIGS. 2A-2E are illustrations of one embodiment of the rapid burrowing robot (RBR).
Figure 2B:
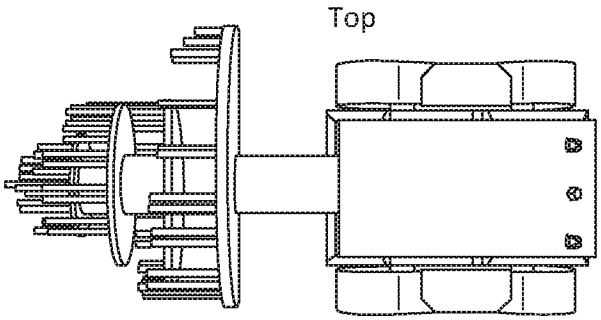
Figure 2C:
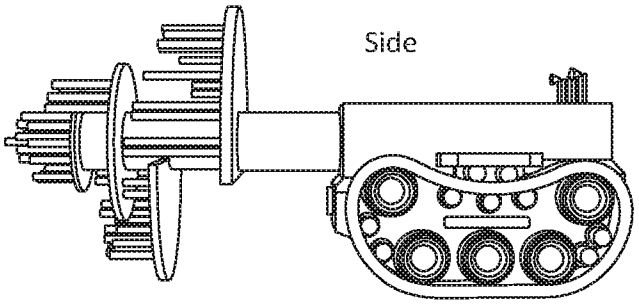
Figure 2D:
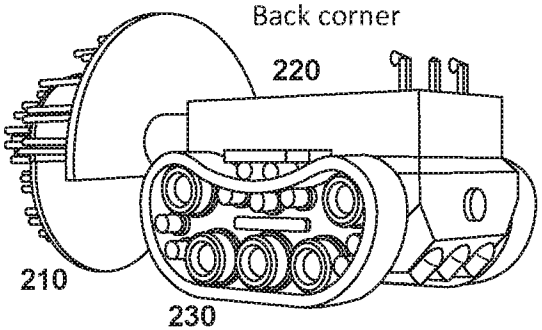

In one embodiment, the torches are arranged in a Fibonacci spiral design, as shown in FIG. 2A. The torches are, in one embodiment, mounted on a support structure which includes disks or partial discs made of a tungsten alloy (or Hf—Ta—C alloy or another material with high melting temperature such as titanium). These rotating discs are mounted to a shaft that spins slowly in the center point, in one embodiment. The torches gasify the material (rock, dirt, ore, etc. collectively the "material").

In one embodiment, the discs are arranged in the spiral pattern, with each disc separated by a small distance. In one embodiment, the separation is 5 cm with ~22 torch nozzles on the first disc and additional torches or torch pairs on each subsequent disc or disc ring segment (collectively referred to as the "Spiral Rig"). In one embodiment, the base unit ("Base RBR") contains 72 torches and bores a tunnel of 1 meter in diameter (see FIGS. 8A-8D).

In one embodiment, RBR's rotating torch element 210 is coupled to a cart enclosure 220, and propulsion system 230 which may include a continuous track, wheels, or other elements. In one embodiment, the cart enclosure 220 is shielded with a class of refractory ceramics called ultra-high-temperature ceramics (UHTCs). UHTCs offer excellent stability at temperatures exceeding 2000° C. The enclosure contains the circuitry, processors, electric motors, and communications equipment needed for the RBR to operate semi-autonomously. In one embodiment, the power management equipment is primarily located at the staging area, with some power management in the enclosures of the first two carts. In one embodiment, the water or other coolant used to cool the plasma torches are circulated from the staging area as well. In one embodiment, the water is recirculated. In one embodiment, the recirculated water may be cooled at the staging area. In one embodiment, the compressed air to increase plume size is also provided. In one embodiment, the air supply may be 1500 cubic feet/minute.

Figure 2E:
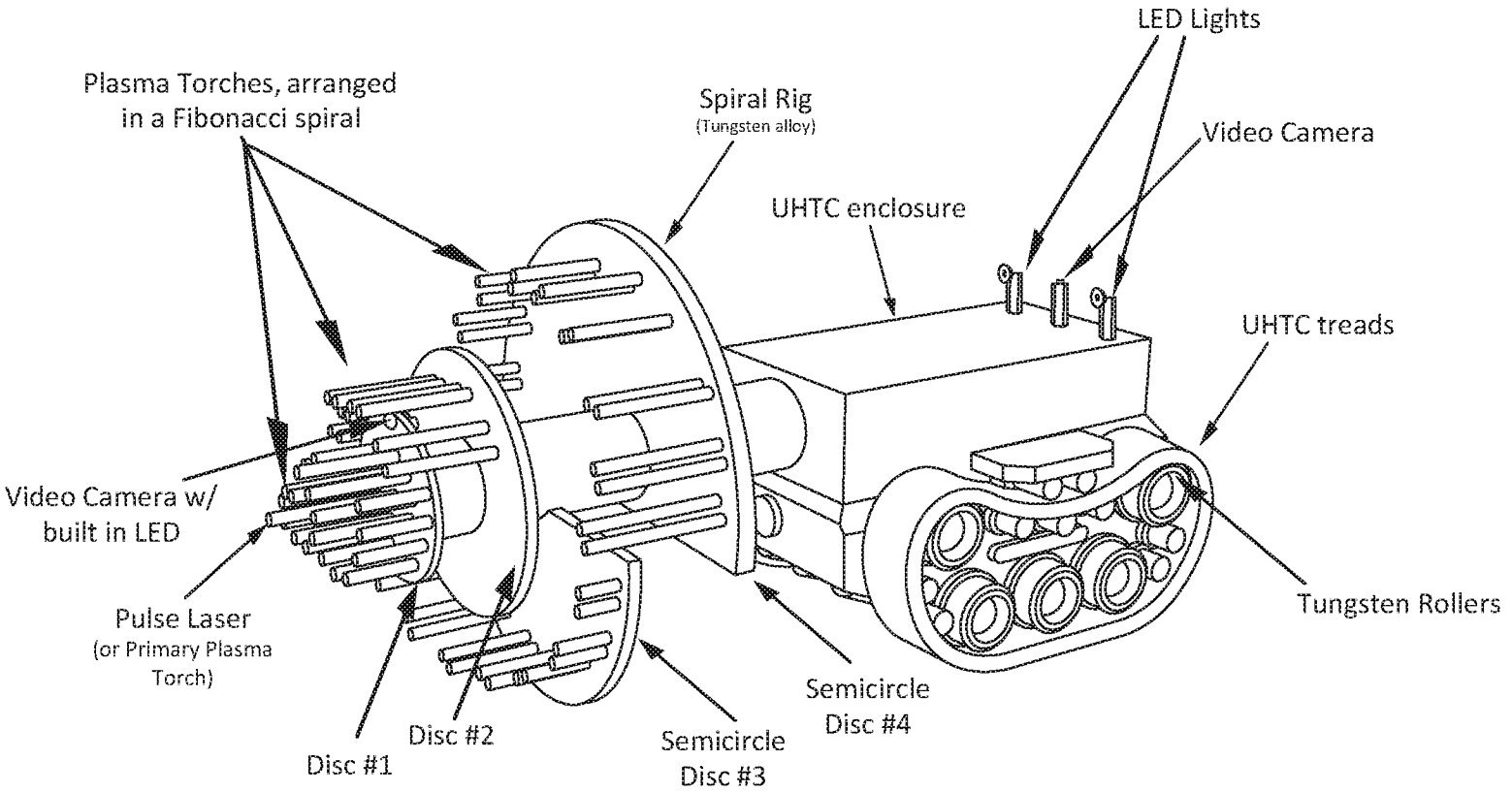

In one embodiment, high-powered LED 240 lights are mounted on the RBR and a series of High Definition video cameras are located on the first disc and near the back of the RBR to monitor progress, as can be seen in FIG. 2E. In one embodiment, the video cameras have pan, tilt and zoom capability, and may be remotely controlled. In one embodiment, the lenses are coated with a nano-coating that significantly mitigates accumulation of dust or other particles. In one embodiment, the RBR also may include sensors, such as temperature and air quality sensors. In one embodiment, the supply line also provides a communication line, which may be a fiber optic communication line, to send back data from the video cameras and sensors.

In one embodiment, the RBR uses continuous tracks made of UHTCs. In one embodiment, the tracks may be embedded with high temperature alloy spikes (for traction). The roller wheels within the continuous tracks may include multiple cooling slots designed to disperse the heat. In another embodiment, the water used to cool the plasma torches can be circulated within the RBR housing and track rollers to remove heat. In one embodiment, the roller wheels are power by individual water cooled and insulated variable speed DC electric motors.

In one embodiment, the minimum power requirement of each plasma torch is 500 kilowatts (0.5 mW) per torch. In one embodiment, the Base RBR, which bores a tunnel with a 1-meter diameter, has a minimum power requirement of approximately 40 megawatts (MW), 72 torches at 0.5 MW=36 MW plus 4 MW (about 10% of the aggregate capacity of the plasma torches) for propulsion and other auxiliary systems. In one embodiment, each non-transferable torch can accommodate up to 1.5 MW of power, or three times (3×) its minimum rated capacity. At three times the power, the temperature and corresponding gasification capacity increases by approximately three times as well. Thus, the theoretical maximum power input is between 40 MW to 120 MW for a 1-meter diameter tunnel. If less power is available, the RBR moves more slowly by optimizing the available power to fewer torches (such as 2 out of every 3 torches, or every other torch). In one embodiment, the RBR may alternately bore a smaller radius tunnel, when there is less power available by focusing the torches in a more constrained area. In one embodiment, some portion of the torches may be modified to be either transferable or non-transferable plasma torches.

Figure 3:
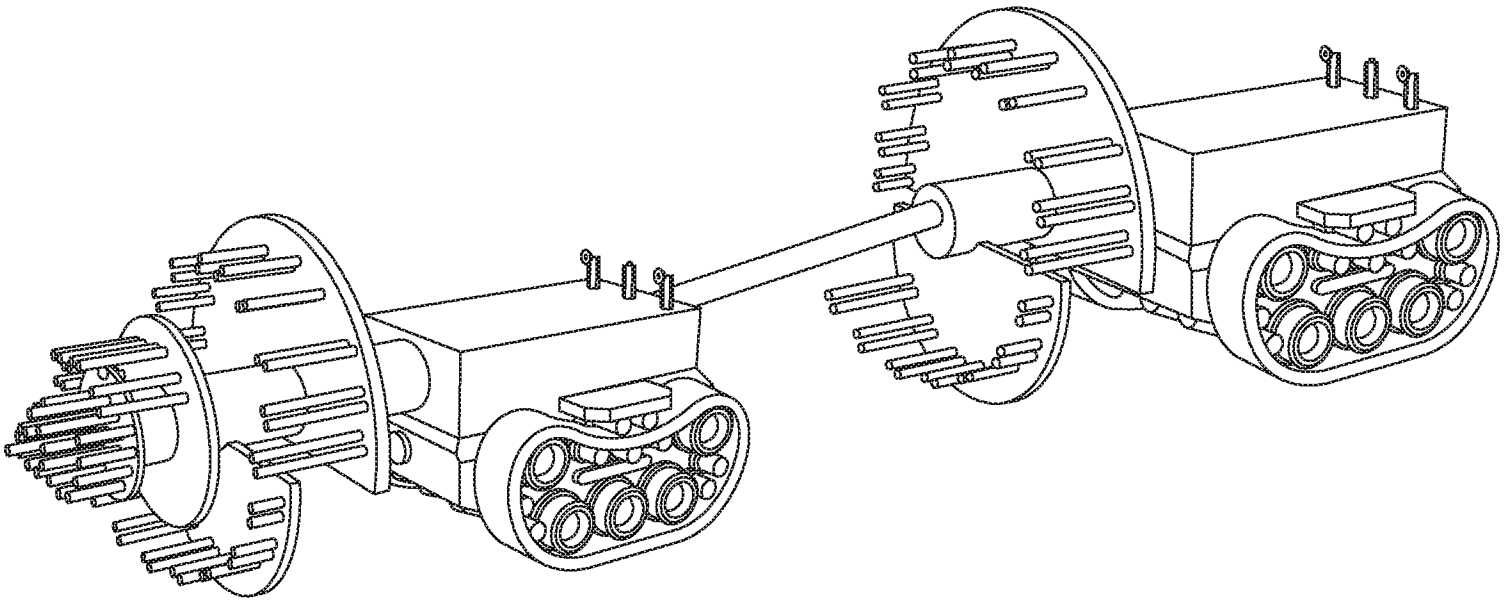
FIG. 3 illustrates one embodiment of an RBR with an attached mother rig.
Figures 4A, 4B, 4C, 4D, 4E:
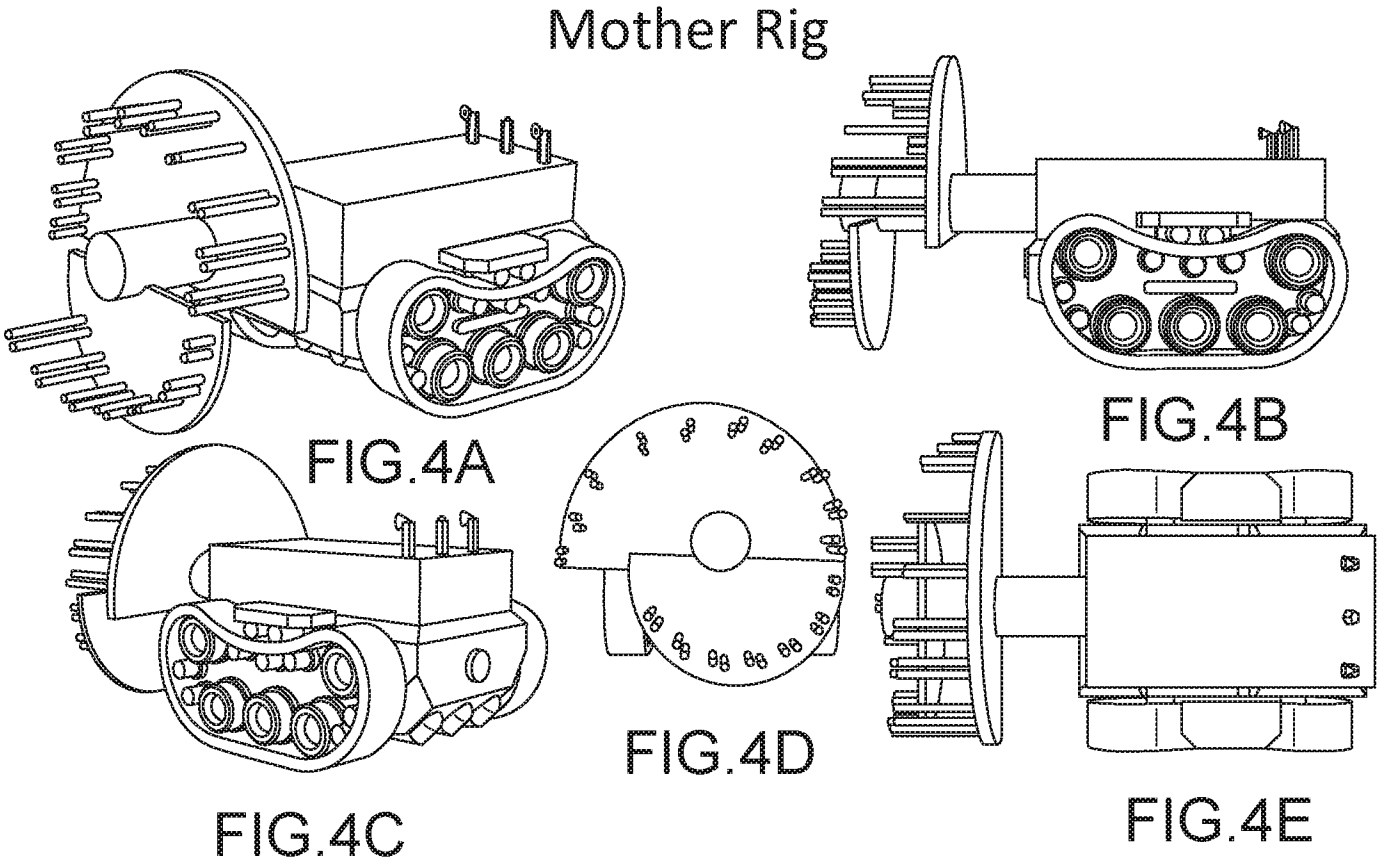
FIGS. 4A-4E illustrate various views of one embodiment of a mother rig.
Figure 5A:
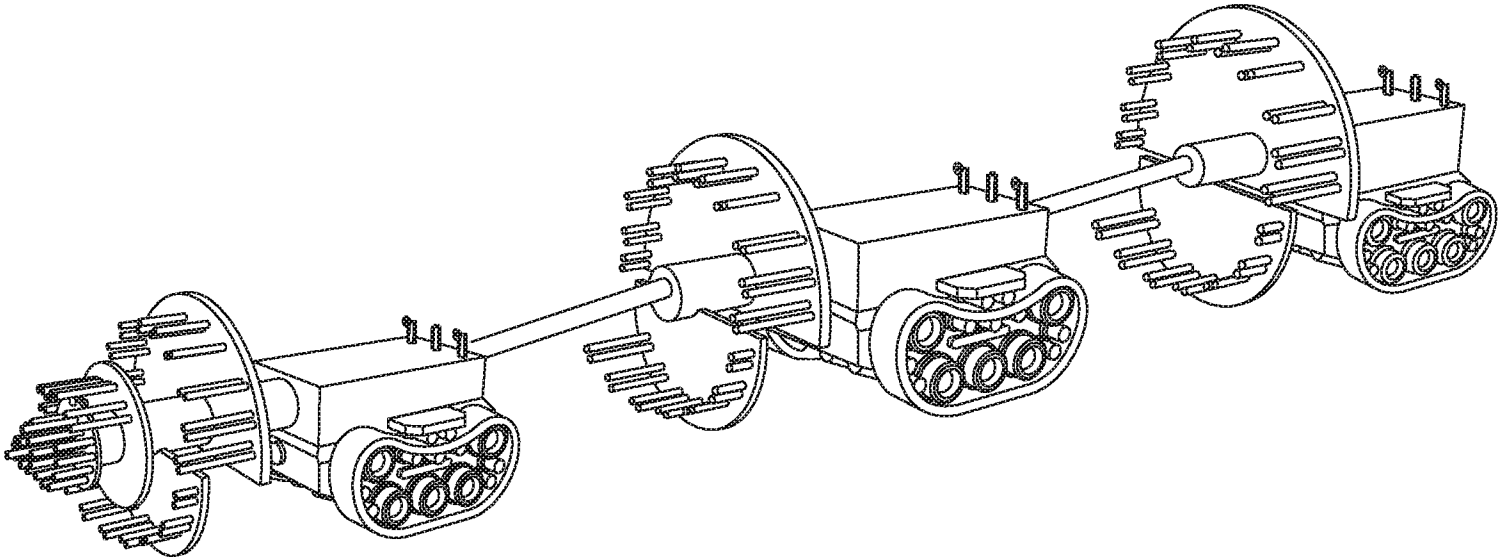
FIGS. 5A-5D illustrate various views of one embodiment of an RBR with a mother rig and a father rig.
Figure 5B:
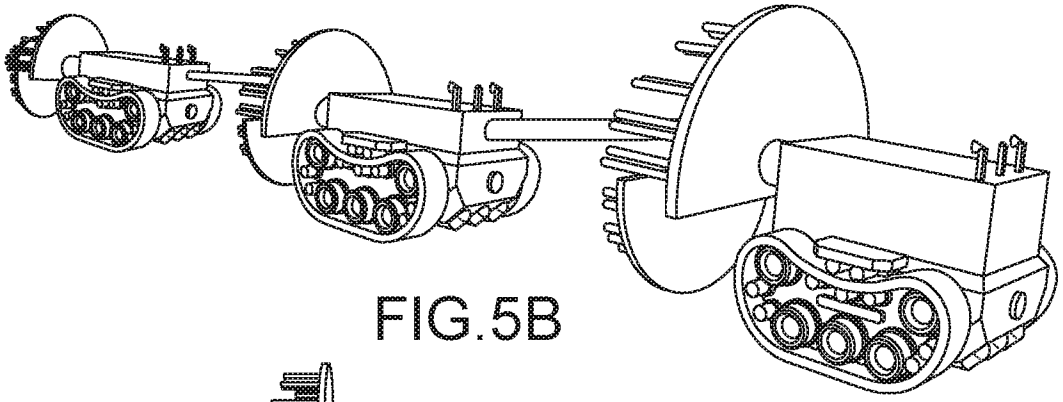
Figure 5C:
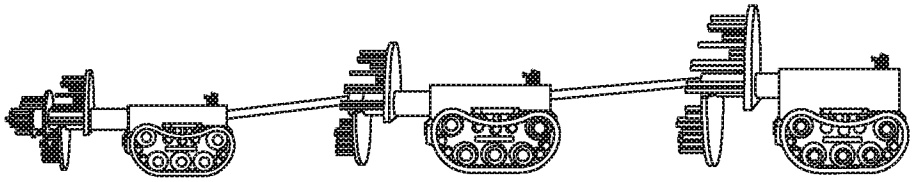
Figure 5D:
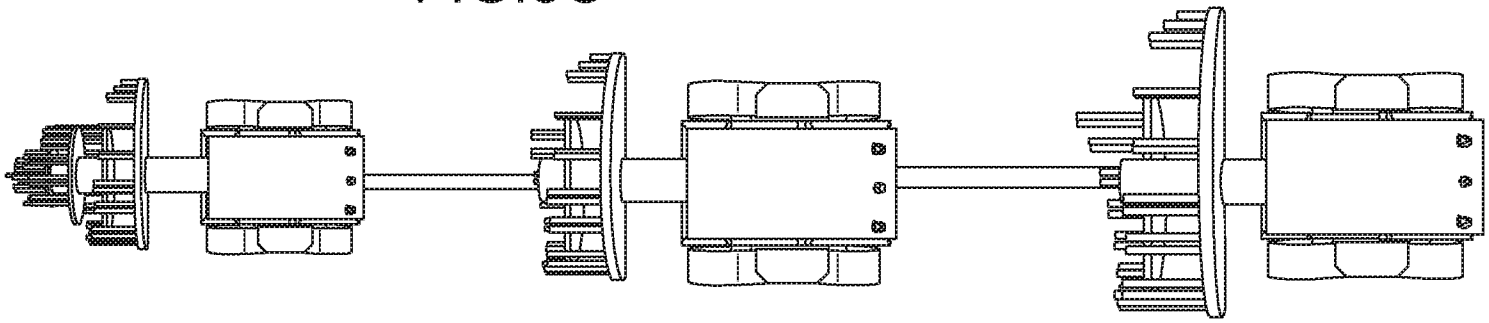
Figure 6B:
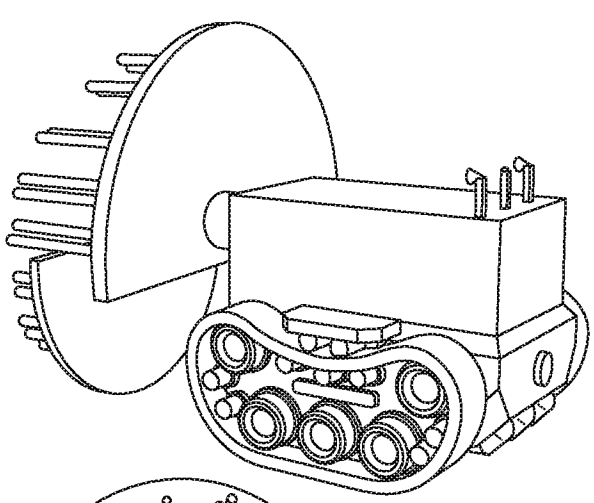
FIGS. 6A-6E illustrate various views of one embodiment of a father rig.
Figure 6E:
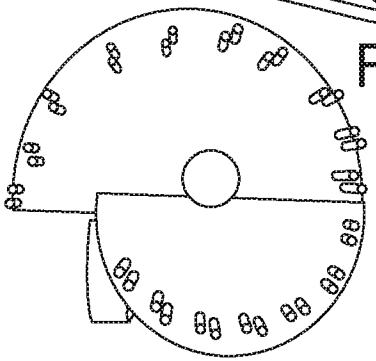
Figure 6A:
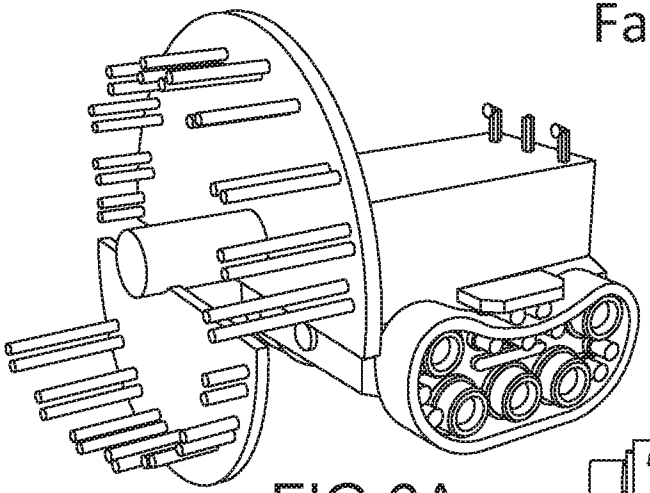
Figure 6D:
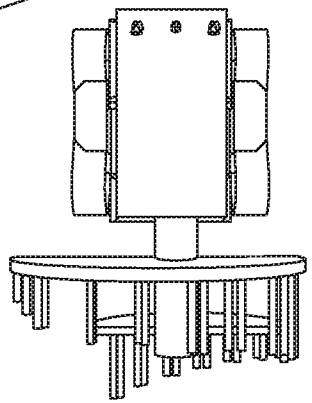
Figure 6C:
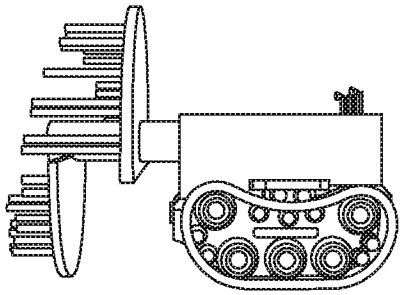
Figures 7A, 7B, 7C, 7D, 7E, 7F, 7G:
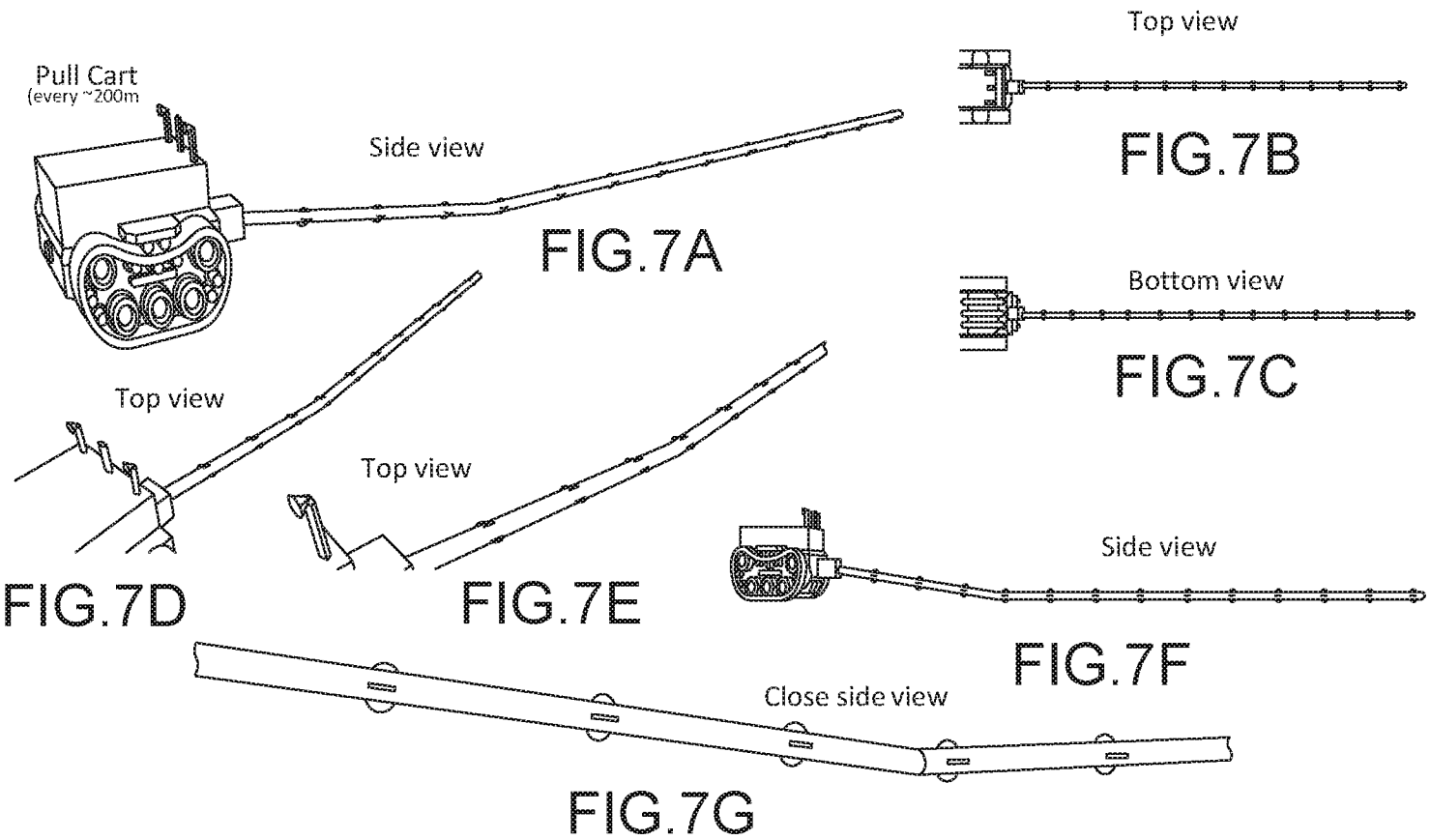
FIGS. 7A-7G illustrate various views of one embodiment of a pull cart and supply cable management system.
Figure 8B:
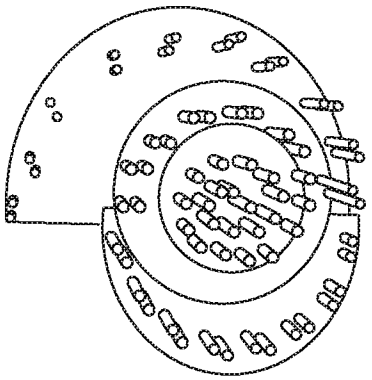
FIG. 8A-8D illustrate various views of one embodiment of a rotating plasma torch element of the RBR.
Figure 8D:
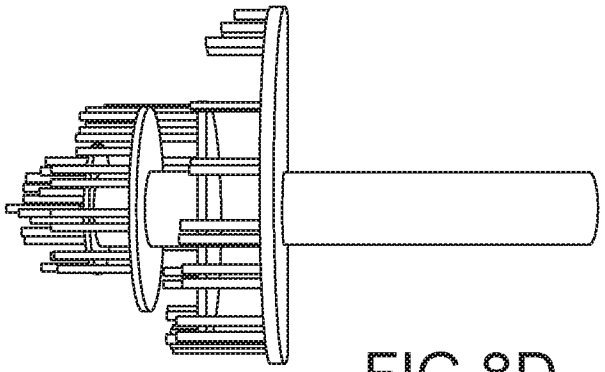
Figure 8A:
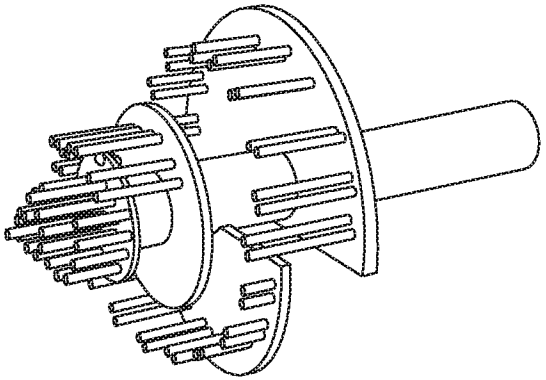
Figure 8C:
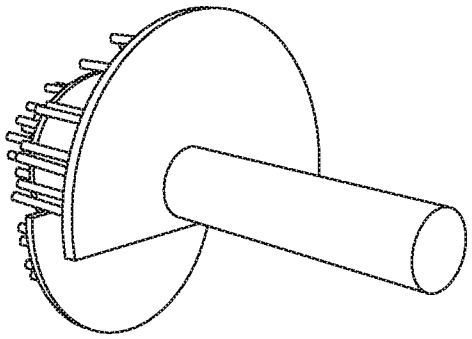

The RBR can be equipped with an optional Stage 2 "Mother Rig" immediately behind the primary RBR, which contains a secondary harness of disc ring segments which can expand the tunnel diameter to up to 3 meters. FIG. 3 shows one embodiment of a mother rig attached to an RBR. FIGS. 4A-4E show various views of one embodiment of a mother rig.

A Stage 3 "Father Rig" of the same design—but with larger ring segments—can be inserted behind the Stage 2 rig for even larger tunnels, as needed. In one embodiment, the Father Rig could bore tunnels of up to 10 meters in diameter. FIG. 5A-5D illustrate various views of one embodiment of a father rig attached to an RBR and mother rig. FIGS. 6A-6E show various views of one embodiment of a mother rig. These additional rigs, if all plasma torches on each of their ring segments are fully utilized, have an estimated minimum power requirement of 120 MW and 300 MW respectively, with maximum power capacity of 360 MW and 900 MW respectively.

The speed of the rotation is related to a combination of the power available to the RBR and the density and composition of the material through which the RBR is tunneling. In one embodiment, the minimum speed is 2 revolutions per minute (RPM). The RPM can be increased as the power increases. In one embodiment, for every 10% increase in power, the RPM can increase by between 5-10% depending on the composition of the material the RBR is drilling through. In one embodiment, 6 RPM is the maximum rotation speed, using one embodiment of the torch design. However, it may be possible to increase the maximum speed beyond RPM, and the present application is not intending to limit the maximum RPM.

To increase RPM, in one embodiment, the RBR may utilize plasma torches that have a higher energy capacity (from 1.5 MW to up to 5 MW each) which could increase the potential maximum RPM by up to 10×. Additionally, the addition of optional plasma torches on a mother rig or a father rig, which would be turned on as more power is added to triple the gasification potential may be used to increase the RPM. In one embodiment, the design shown in FIG. 3 could increase the maximum RPM by 3×.

In one embodiment, the Mother Rig and Father Rig, having more space to insert additional ring segments, could add additional torches to increase capacity by at least 5× and 10× respectively for larger tunnels, subject to power availability and geology.

The adjustable nature of the RBR allows for flexible tunnel sizes, ranging from about 0.5 meters to 2 meters in diameter. Larger versions with extra rigs carrying additional rings of torches behind the initial rig can bore tunnels of 10 meters in diameter or larger.

The forward tunneling speed of the RBR is determined by how quickly the material it is moving through gasifies. In one embodiment, the RBR gently pushes into the material, applying a constant pressure and moves forward as the material in front of it gives way to gasification or ash. In other words, the speed is variable based on how quickly the RBR gasifies the material. This depends on the material and the energy output of the torches. In one embodiment, the RBR may push into the material slowly, and pause to allow the temperature to decrease before moving forward into space that was previously occupied by the removed material.

The power supply cables and consumables supply lines to the RBR are connected to the back end of the RBR, in one embodiment. FIGS. 7A-7G illustrate various views of one embodiment of a pull cart and cable management system. In one embodiment, the pull cart provides a cable management system including tungsten or titanium wheels with modest on-board electric propulsion to eliminate drag on the RBR. In one embodiment, carts contain expanding/collapsing connection rods, which are each between 2-5 meters long and connect a series of carts. The connection rods provide protection for the cable, which extends from the pull cart to the base station outside the tunnel. The supply conduits lead power (electricity), coolant (water), plume dispersant (compressed air), and communication cabling (fiber optic cable) to the rigs. In one embodiment, the carts contain sensors that monitor the temperature of the tunnel floor as they pass over it. Although FIGS. 7A-7G and FIGS. 10 and 11 illustrate a single conduit, the system may include separate conduits. In one embodiment, the separate conduits are encased in a single temperature managed cable enclosure, for protection from the heat and dust.

Figure 10:
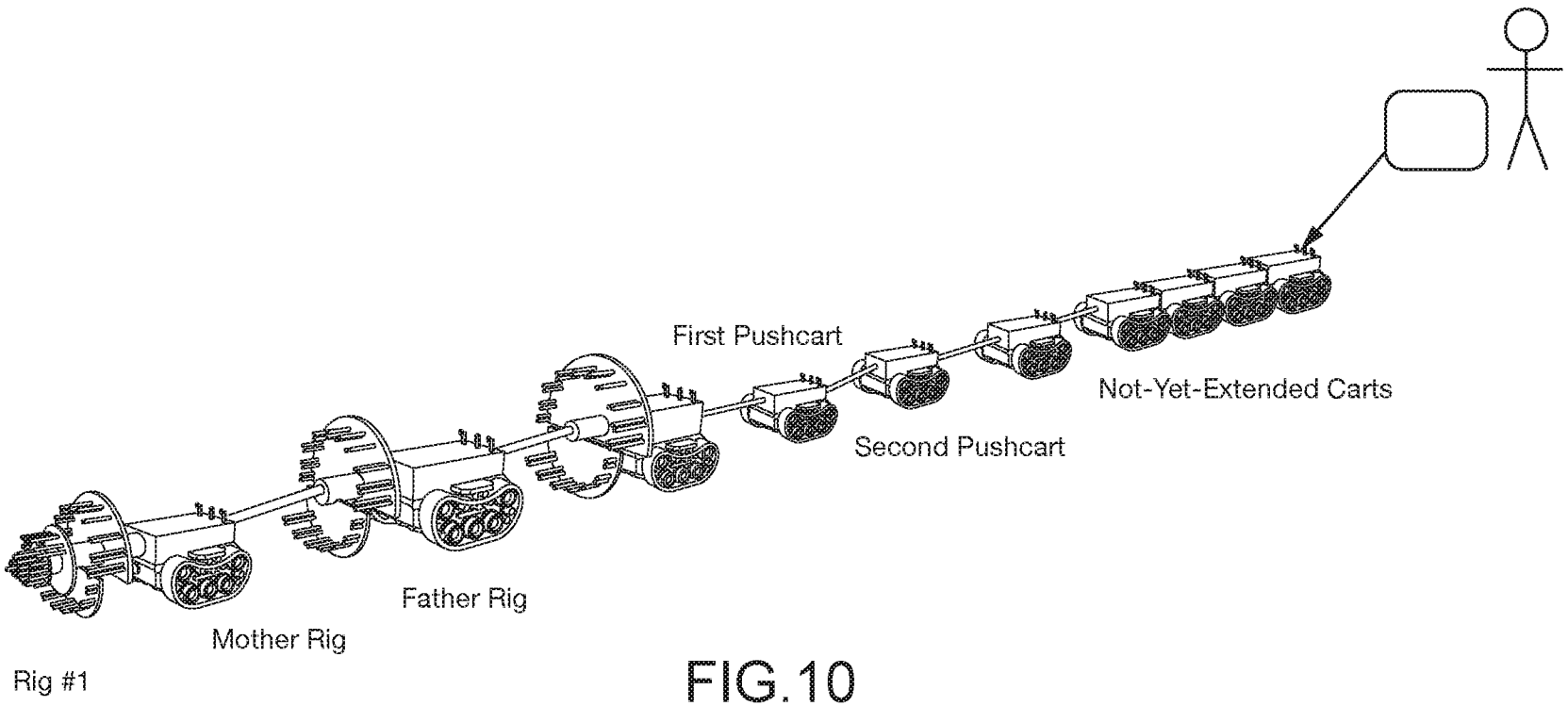
FIG. 10 is a diagram of one embodiment of a system with a pull cart based cable management mechanism.

In one embodiment, carts are approximately 0.5 meters by 0.5 meters by 0.5 meters. Each Cart follows the preceding cart by 3 meters when the supported interlocking jointed arm ("Arm") is fully extended, in one embodiment. When the Arms are fully collapsed the Carts compress together into a length that is roughly 6 times shorter than their fully extended length to allow for easier transport. In one embodiment, the RBR is designed to accommodate at least 110 Carts, so it can tunnel at least 1 kilometer from any staging point where the Carts have been staged in a compressed arrangement. FIG. 10 illustrates one embodiment of the staging point, with carts in close proximity, and showing the sequence of carts that are strung along to provide cable management and reduce drag on the system. FIG. 10 is not to scale, since the expected spacing between carts is between 2 meters and 10 meters. Although only a few carts are illustrated, in a real implementation, the system may include over 100 carts.

Figure 11:
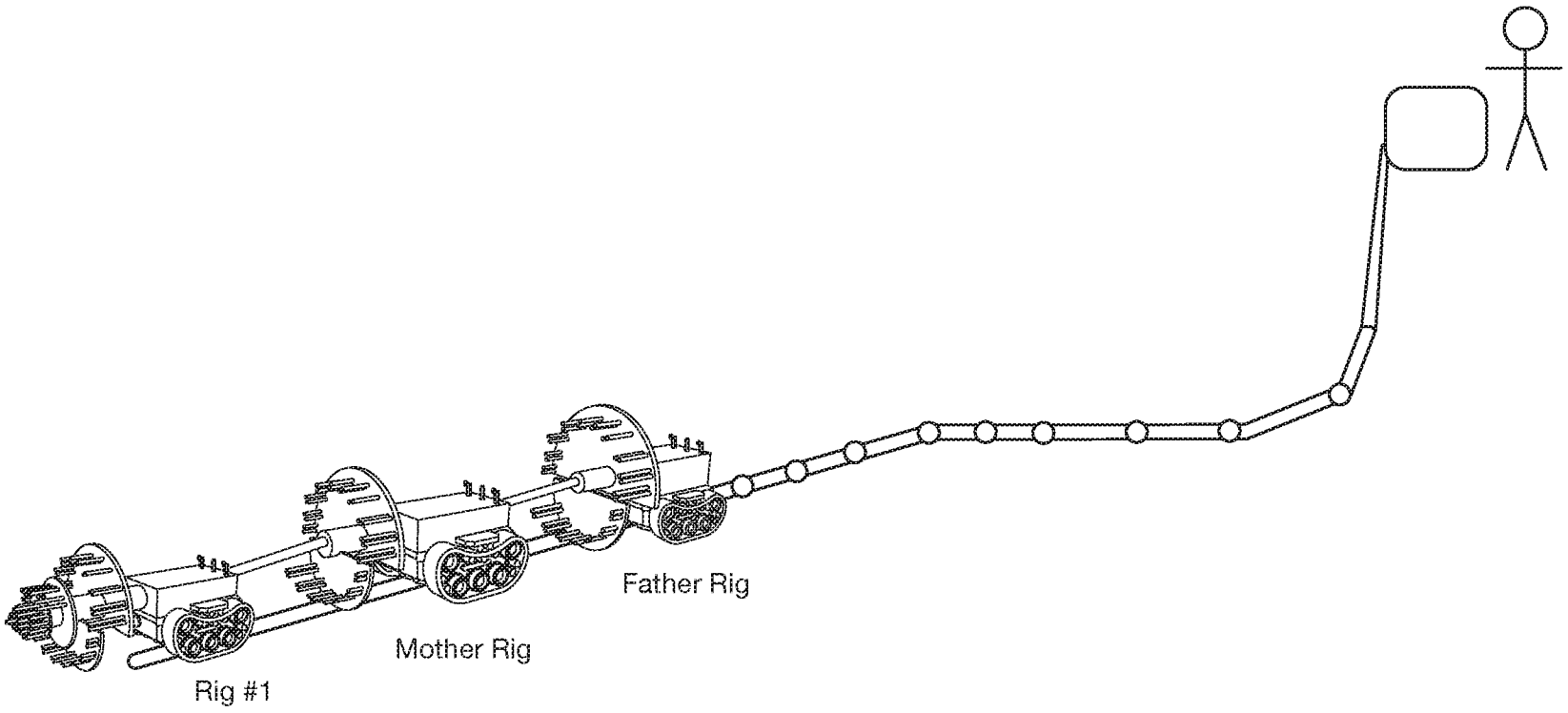
FIG. 11 is a diagram of one embodiment of a system with a wheeled cable management mechanism.

In another embodiment, the power, supply & communications cables may be rolled up in a protective tube (in one embodiment made with a refractive liner) lined on the outside with wheels, as illustrated in one embodiment in FIG. 11. In one embodiment, the wheels may be small (such as roller blade sized) made of tungsten or titanium with tungsten or titanium ball bearings. The wheels are spaced approximately every 20 cm. In one embodiment, there are wheels all the way around the circumference of the tube every 20 cm. The tube could simply be pulled behind the RBR and/or Mother/Father Rig, without a separate pull cart. In one embodiment, the first 20-30 meters or so would be heavier, with stronger refractive protection since that's the portion that would be exposed to the most heat until the tunnel walls cool enough to eliminate the need for any protection In one embodiment, a backup RBR with the spiral rig/torches removed (or pull cart) could be placed periodically to create additional torque for the cables if needed. In one embodiment, the backup torque carts may be placed every 200-500 meters. The cable tube could be wound up on large spools for preparation for each tunneling job. The ends of the cable tube on each wheel have modular connectors, in one embodiment.

The RBR is designed to create a safe, usable tunnel without concrete liners due to the thick liquefied/vitrified rock tunnel walls created by the RBR process. Of course, the wall thickness and strength are fully dependent on the composition of the material, so robotic inspection and constant sampling of the gases by the RBR help to inform the operators whether concrete tunnel liners are necessary. In one embodiment, sensors on each of the carts monitor temperature and mineral content of the material being melted or vaporized, and some carts are equipped with additional sensors and video cameras to provide additional data to the operators. Robots can enter tunnels after the Material is sufficiently cool, if needed, for further inspection and/or to begin installing HVDC power cables, pipelines, or other uses.

The outer portions of the Material that is not fully gasified due to lower temperatures would be liquefied and as it cools under pressure would naturally form a glass-like wall lining the tube, similar to a lava tube, for some materials. In one embodiment, up to 60% of the Material encountered in the tunnel could be vitrified and/or compressed into the tunnel walls. Removal of the Material that does not become part of the tunnel walls is removed. In one embodiment, the Material is removed through the use of a vacuum created behind the RBR, to pull the gasified Material back to the surface, including any Material that precipitates into sand or silt as it cools. In one embodiment, a vacuum system is at the staging area, and suction is created in the entire tunnel to remove the gasified and particulate material.

In general, the Material would be small chunks of rock, sand and/or silt. In one embodiment, such Material could be sold for use in construction applications. In one embodiment, the Material is melted rather than vaporized and removed using a conveyor system, although this application would be utilized only in the unlikely event where either geology requires melting rather than vaporization, or where sufficient power is unavailable for Material vaporization. (giant vacuum at the staging area) (air compressor/water cooling & recycling system)

The variable speed feature of the RBR allows for a very high peak power limit, to tunnel very rapidly under the right geological and electricity cost conditions. Initial engineering suggests that tunneling through limestone (melting temperature of 825° C. with its calcium carbonate component having a melting temperature of 1,339° C. and limestone gasification temperature of 1500° C.) and soil with the RBR could be up to 250 meters per day for large 3 to 10-meter diameter tunnels, or 10 times faster than Martina Tunnel Boring Machine by Herrenknecht AG. Smaller diameter 1-2-meter tunnels for a HVDC cable could be carved out at even higher speeds: preliminary engineering estimates tunneling speeds of 1 kilometer per day when connected to a 100 MW wind or solar farm with an above average capacity factor.

The rate (speed) of tunneling is directly proportionate to the level of power (current) from the DC input, making it flexible and variable speed depending on the composition of the material being gasified at the time. Therefore, the tunneling speed can be reduced during times when electricity is expensive, and increased during times when electric rates are cheap. This gives great flexibility in managing tunneling cost, since energy consumption would otherwise be the largest variable operating cost.

In one embodiment, the RBR is able to bore tunnels at speeds of 10 to 55 times faster, or greater, than conventional tunneling techniques using low cost 100% renewable energy while helping to mitigate curtailment of wind and solar energy during "over-production" periods—all while eliminating the need to solve the development timelines delays of up to 10 years for above-ground transmission projects. This leads to significant cost savings.

One of the sources of cost savings is that the "drilling" function uses heat, rather than mechanically spinning drill, rotors or cutters. There are very few moving parts, with none of the moving parts perform any of the work need to bore the tunnel. Therefore, the friction-based wear and tear of conventional drilling is eliminated, lowering parts and mechanical related operating costs substantially. Note that plasma torches have consumables that need replacement, including the electrode, nozzle and shield. The cost & frequency of replacement of these consumables is much lower than conventional drilling parts.

Due to the vastly reduced mechanical and parts related costs, and the fact that the RBR is 100% robotic, the labor usually needed to regularly replace, lubricate and maintain these parts is eliminated, whether on the surface for horizontal drilling of small diameter boring over short distances or within larger tunnels with manned rigs. This further reduces operating costs substantially by eliminating most labor costs.

The temperature of the plasma torches is a direct function of the current of electricity. In one embodiment, therefore, the RBR can increase the temperature to gasify hard rock like granite or dolomite in mountain ranges as needed. This not only eliminates the heavy wear & tear on conventional boring heads and saves costs, but also allows a consistent rate of tunneling per hour by simply increasing the current to the torches avoiding costs associated with prolonged delays of the tunneling project. In one embodiment, water is used for cooling of the plasma torches, and the volume of water circulating within the water supply and return hoses can be increased or decreased as needed based on geology, RBR tunneling speed, power being delivered to the RBR, and other factors. In one embodiment, the RBR software control systems shall automatically adjust water flow rates, electric current, RBR propulsion speed, compressed air flow to the plasma torches, and other control systems based on input from the sensors incorporated into the RBR.

In one embodiment, the energy to the RBR can be scaled up during times when the value of the solar/wind energy is cheapest (such as off-peak nighttime hours or highly sunny days when the local grid cannot absorb all the solar energy). In many cases, the DC energy will be free or negative priced (the RBR would earn income simply by operating, similar to a "tipping fee") during those times when the grid operator declares a curtailment event at the wind/solar farm due to severe congestion on the grid. This leads to very low energy costs to operate the RBR, in one embodiment.

Due to the vitrification of the rock at the edges of the tube, a seal is created that provides for:

a. Structural integrity of the tube (which could be reinforced with concrete or other methods);
b. Prevention or reduction of liquids entering the tunnel such as water;
c. Prevention of reduction gases (radon, methane, CO, etc.) entering the tunnel; and
d. Ability to store compressed air in the tunnel for the purposes of:
   i. Energy storage potential (via compressors that run in reverse to capture the stored energy of compressed air like the techniques developed by Lightsail and others;
   ii. To create a pressurized environment to mitigate entry into the tunnel of unwanted gases and/or liquids; and
   iii. To create pressure that acts as a catalyst for the RBR to improve its efficiency in gasifying & liquefying material.
e. Depending on the geologic composition, some portions of the tunnel(s) (where people or vehicles won't be present) is likely to eliminate the need to install concrete tunnel liners due to this glassification, saving additional money and time.

In one embodiment, since RGB utilizes the gasification of the rock and minerals, a gaseous spectral method (gas chromatography—mass spectrometry) can be used to identify high value minerals such as rare earths for potential extraction. This would further offset the costs of tunneling by recovering some portion of the high value materials displaced.

Initial engineering estimates of tunnel boring costs suggest that the RBR could reduce costs by up to 80% over conventional methods, even at a rate of boring up to ten times faster (excluding recovery of high value minerals). As renewable energy becomes increasingly less expensive than conventional fossil fuels—and as more renewable energy on the system causes even greater curtailment and "over-generation" periods—the cost to operate the RBR will continue to decline over time since the single largest cost is electricity. There may even be some locations of the world where the tunneling cost approaches zero due to optimization of "over-generation" periods to tunnel for "free." This is the exact opposite thesis of conventional tunneling techniques which will increase with cost over time as materials and labor costs increase One of the things that RBR may be able to address is the aging infrastructure. RBR may provide rapid deployment of new transmission structures. Conventional transmission takes 6-10 years to obtain all the necessary permits and rights of way. The RBR could bore transmission tunnels at rates of 250 meters to 1 kilometer per day, under existing rights of way owned by transmission companies, utilities or railroads, without the need to obtain any above ground rights of way. Only subsurface rights of way from cooperative government, utility or private landowners are needed, and the permitting process would be greatly simplified. The RBR could save years of development time and up to 70% of the development cost of such projects. The RBR can help replace outdated transmission (and medium voltage distribution) lines, build new transmission lines equipped with smart grid electronics, and build out regional and ultimately global Super-grids. The tunnels created using the RBR can be a part of a neural self-healing network of super high voltage DC smart transmission segments. Such tunnels connect: Remote renewable energy resources, Weak points in the existing transmission system, Population load centers, Countries, and Continents.

The tunnels created using RBR can also be part of a super-grid backbone overlaid (underlain) by the RBR onto key nodes of the existing transmission system. The backbone could re-route energy in the event of natural disasters or other events that cause an interruption in the normal operations of the conventional electric grid.

Using the connections between heavily built-out wind and solar regions, curtailment is eliminated as the "over-production" negative or low energy pricing periods simply mean that any "excess" clean energy can now be sent to other regions for consumption. Portions of this excess energy can also be utilized by the RBR to bore more tunnels, or bore them faster by stepping up the current to the RBR during these times.

During evening peak periods on the East Coast, the sun is still shining in the West. Similarly, during evening peak on the West Coast, the wind is already blowing strongly in the Midwest. The RBR could connect the east and west coast together with the Midwest to move large quantities of renewable energy in remote areas to the big cities. The sun is always shining and the wind is always blowing somewhere, so connecting large regions together increases the percentage of intermittent renewable energy that can be affordably integrated into the electric grid.

In one embodiment, the melted rock will form airtight tunnels. With seals on two ends, glassy walls of the tunnel can be used to form an air-tight tube which can be pressurized with compressed air, for energy storage purposes. The length of many of these tunnels should facilitate a very large vessel for storing large quantities of compressed air for recapturing in the form of electricity by running the compressors backwards when the compressed air is released later when needed. This allows storage of days, weeks or even months' worth of low cost renewable energy (produced during "off-peak" times such as weekends and night-time after 11 pm) to drastically increase the level of potential renewable energy penetration in the electric system. Such long-term energy storage would render gas peaking plants nearly or fully obsolete, as well as inflexible baseload coal or nuclear power stations.

Both large wind and solar plants as well as distributed generation (like rooftop solar, battery energy storage, geothermal, micro hydro-electric turbines, and other localized distributed energy resources) could scale up with immediate and massive deployment once the timeframe is known for nearby Super-grid nodes to be activated.

Figure 9:
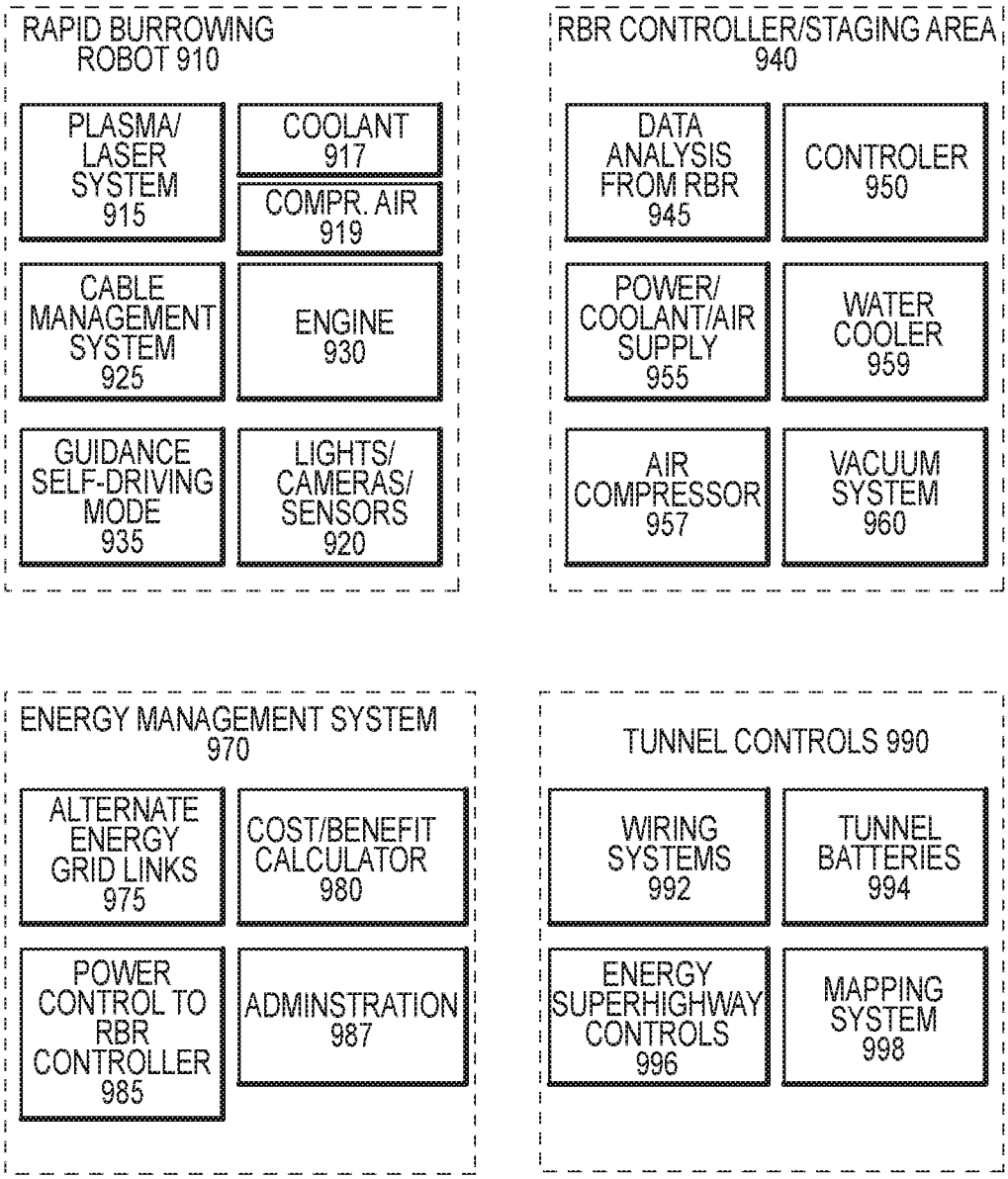
FIG. 9 is a block diagram of one embodiment of the RBR system.

FIG. 9 is a more detailed illustration of one embodiment of the elements of the system. The rapid burrowing robot 910 includes, in one embodiment, a plasma/laser system 915, and a coolant 917 and compressed air or other plume enhancement mechanism 919. In one embodiment, the coolant is water, which is circulated from the controller/staging area 940. In one embodiment, the rapid burrowing robot 910 further includes lights/cameras/sensors 920, a cable management system 925, and an engine 930. In one embodiment, the rapid burrowing robot 910 also includes a self-driving guidance system, which enables the RBR 910 to be self-propelled without external controls. As noted above, the sensors 920 may include a camera, as well as air quality sensors, and heat sensors. The cable management system 925 may include one or more pull carts to manage the cables, or wheels or other mechanisms to enable the pulling of the cable. The cable couples the rapid burrowing robot (RBR) 910 to the RBR controller 940.

The RBR controller/staging area 940 may include a data analysis system, from the RBR. The data analysis system 945 takes data from the cameras and sensors 920 of the RBR 910, and provides analysis on the optimal speed, and mechanism for burrowing. For example, for dense rock that's highly conductive a smaller surface area hotter plasma may be used, compared to a more porous rock that liquefies easily.

Controller 950 controls the RBR 910. In one embodiment, the controller 950 receives data from the RBR 910. In one embodiment, the controller 950 controls the RBR 910 by sending it the appropriate level of power, coolant, and air supply 955. In one embodiment, the controller/staging area 940 further includes a water cooler 959, to cool the water circulating to the RBR's plasma torches 915. In one embodiment, a vacuum system 960 is used to remove gasified material and/or debris from the tunnel.

In one embodiment, RBR controller 940 may be controlled by a human "driver," who provides instructions to the RBR 910 in real-time. In another embodiment, the driver may utilize the RBR controller 940 to set up a planned path/routine/energy usage pattern for the RBR 910 and allow the self-driving guidance system 935 to provide real-time controls.

The speed/power controls 955 provide the propulsion to the RBR 910. In one embodiment, they are coupled to the controller 950. Thus, the speed of the RBR 910 may be set based on the available power (via speed/power controls 955 and the type of material that the RBR 910 is encountering. The speed/power controls 955 interface with energy management system 970.

The energy management system 970 provides a tap into the alternate energy grid 975. Alternate energy refers to renewable energy sources, such as solar, hydropower, wind power, etc. In one embodiment, the RBR 910 is optimized to use renewable energy and to adjust its power consumption to minimize cost. In one embodiment, the RBR 910 may be run purely on alternative energy, whether dedicated or obtained from the grid.

Cost-benefit calculator 980 utilizes the data from the energy grid, or alternative energy supply 970, to determine the optimal speed for the RBR 910. In one embodiment, the cost-benefit calculator 980 may take into account all the available factors, including the urgency of completing the tunnel being bored.

In one embodiment, the output of the energy management system 970 is coupled to RBR controller 940 via power control 985. Administration 987 provides the payment for the energy. In one embodiment, the administration 987 may interface with a plurality of energy providers, to obtain the best priced energy resources for the RBR 910.

In one embodiment, the RBR 910 creates a self-closing tunnel. This tunnel may be utilized for a variety of reasons. Tunnel controls 990 provide some exemplary uses of such tunnels. In one embodiment, the tunnel may be used as part of a wiring system 992. Wires, such as gas, electricity, fiber, and copper need to lead to every home and business, to provide the basic utilities. The tunnel system may be used with wiring systems 992 to provide a location for such wiring. Wiring, in this context includes plumbing, such as water supply and sewer system.

In one embodiment, the tunnel may be used as a battery 994. The battery may consist of stored compressed air. High pressure compressed air is a safe, reasonably cheap, and simple way of storing energy. In one embodiment, the tunnel battery 994 may be used by the RBR 910 to fuel further burrowing.

In one embodiment, the tunnel may provide energy superhighway controls. The "energy superhighway" in this example is a connected grid of tunnels that may be used to lead fiber the last mile, and to provide a safe and secure power grid.

In one embodiment, the tunnels may be used as part of a mapping system 998, to map out an area and create a pathway. In some other embodiments, the tunnels created may be used for transportation, secure storage, and other purposes.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

I claim:

1. A tunnel boring machine, comprising:
- a propulsion system;
- a torch support structure carried by the propulsion system, including:
  - a disc mounted on a rotatable shaft; and
  - at least one partial disc spaced apart from the disc and mounted on the rotatable shaft; and
- a plurality of plasma torches carried by the torch support structure, wherein at least selected ones of the plurality of plasma torches are mounted to the disc and at least selected other ones of the plurality of plasma torches are mounted to the at least one partial disc.

2. The tunnel boring machine of claim 1, wherein the plurality of plasma torches are arranged on the torch support structure in a spiral pattern.

3. The tunnel boring machine of claim 1, wherein the plurality of plasma torches are arranged on the torch support structure in a Fibonacci spiral.

4. The tunnel boring machine of claim 1, further comprising a laser positioned proximate the center of the disc.

5. The tunnel boring machine of claim 1, wherein at least selected ones of the plurality of plasma torches comprise non-transferred arc plasma torches.

6. The tunnel boring machine of claim 1, wherein at least selected ones of the plurality of plasma torches comprise transferred arc plasma torches.

7. A tunnel boring machine, comprising:
- a propulsion system;
- an enclosure carried by the propulsion system;
- a torch support structure carried by the enclosure, wherein the torch support structure comprises a primary disc mounted on a rotatable shaft carried by the enclosure;
- a first plurality of plasma torches mounted to the primary disc;
- a power supply cable coupled to the enclosure and adapted to supply power to the boring machine from one or more power sources; and
- a control system configured to select the one or more power sources from among multiple available power sources based on a corresponding cost and a corresponding availability of each of the multiple available power sources.

8. The tunnel boring machine of claim 7, wherein the multiple available power sources comprise at least two of solar power, wind power, geothermal power, hydro power, tidal power, wave power, power derived from biofuel, or power derived from fossil fuel.

9. The tunnel boring machine of claim 7, further comprising a laser positioned proximate the center of the disc.

10. The tunnel boring machine of claim 7, wherein at least selected ones of the plurality of plasma torches comprise non-transferred arc plasma torches.

11. The tunnel boring machine of claim 7, wherein at least selected ones of the plurality of plasma torches comprise transferred arc plasma torches.

12. A tunnel boring system, comprising:

a first tunnel boring machine, comprising:

a first propulsion system;

a first enclosure carried by the first propulsion system;

a first torch support structure carried by the first enclosure, wherein the first torch support structure comprises a first disc mounted on a first rotatable shaft carried by the first enclosure, and wherein the first disc has a first diameter; and a first plurality of plasma torches mounted to the first disc;

a second tunnel boring machine, comprising:

a second propulsion system;

a second enclosure carried by the second propulsion system;

a second torch support structure carried by the second enclosure, wherein the second torch support structure comprises a second disc mounted on a second rotatable shaft carried by the second enclosure and wherein the second disc has a second diameter larger than the first diameter; and a second plurality of plasma torches mounted to the second disc; and a first supply cable extending from the first enclosure to the second rotatable shaft.

13. The tunnel boring system of claim 12, further comprising a power supply cable coupled to the second enclosure and adapted to supply power to the boring system from one or more power sources.

14. The tunnel boring system of claim 13, further comprising a control system configured to select the one or more power sources from among multiple available power sources based on a corresponding cost and a corresponding availability of each of the multiple available power sources.

15. The tunnel boring system of claim 12, further comprising a third tunnel boring machine, comprising:

a third propulsion system;

a third enclosure carried by the third propulsion system;

a third torch support structure carried by the third enclosure, wherein the third torch support structure comprises a third disc mounted on a third rotatable shaft carried by the third enclosure and wherein the third disc has a third diameter larger than the second diameter; and a third plurality of plasma torches mounted to the third disc; and a second supply cable extending from the second enclosure to the third rotatable shaft.

16. The tunnel boring system of claim 15, further comprising one or more push-carts connected to the third tunnel boring machine.

17. A tunnel boring machine, comprising:

a propulsion system;

a torch support structure carried by the propulsion system; and a plurality of plasma torches carried by the torch support structure, wherein the plurality of plasma torches are arranged on the torch support structure in a Fibonacci spiral.

18. The tunnel boring machine of claim 17, wherein the torch support structure comprises a disc mounted on a rotatable shaft carried by the propulsion system, and wherein at least selected ones of the plurality of plasma torches are mounted to the disc.

19. A tunnel boring machine, comprising:

a propulsion system;

an enclosure carried by the propulsion system;

a torch support structure carried by the enclosure, wherein the torch support structure comprises a primary disc mounted on a rotatable shaft carried by the enclosure and at least one secondary disc spaced apart from the primary disc and mounted on the rotatable shaft;

a first plurality of plasma torches mounted to the primary disc and a second plurality of plasma torches mounted to the at least one secondary disc; and a power supply cable coupled to the enclosure and adapted to supply power to the boring machine from one or more power sources.

20. The tunnel boring machine of claim 19, further comprising a control system configured to select the one or more power sources from among multiple available power sources based on a corresponding cost and a corresponding availability of each of the multiple available power sources.

21. The tunnel boring machine of claim 19, wherein at least selected ones of the first and second pluralities of plasma torches are arranged on the torch support structure in a Fibonacci spiral.

* * * * *